US010165920B2

(12) United States Patent
Blanchard et al.

(10) Patent No.: US 10,165,920 B2
(45) Date of Patent: Jan. 1, 2019

(54) HANDLE ASSEMBLY FOR A VACUUM CLEANER

(71) Applicant: Dyson Technology Limited, Wiltshire (GB)

(72) Inventors: Oliver Stanton Blanchard, Bristol (GB); Paul Andrew McLuckie, Bristol (GB)

(73) Assignee: Dyson Technology Limited, Malmesbury, Wiltshire (GB)

( * ) Notice: Subject to any disclaimer, the term of this patent is extended or adjusted under 35 U.S.C. 154(b) by 37 days.

(21) Appl. No.: 15/271,978

(22) Filed: Sep. 21, 2016

(65) Prior Publication Data

US 2017/0079495 A1 Mar. 23, 2017

(30) Foreign Application Priority Data

Sep. 21, 2015 (GB) ..... 1516665.5

(51) Int. Cl.

*A47L 9/32* (2006.01)
*A47L 9/00* (2006.01)
*A47L 9/24* (2006.01)

(52) U.S. Cl.

CPC ..... *A47L 9/32* (2013.01); *A47L 9/0081* (2013.01); *A47L 9/24* (2013.01); *A47L 9/248* (2013.01); *A47L 9/327* (2013.01)

(58) Field of Classification Search

CPC ..... A47L 9/0081; A47L 9/24; A47L 9/248; A47L 9/32; A47L 9/327

See application file for complete search history.

(56) References Cited

U.S. PATENT DOCUMENTS 5,411,150 A * 5/1995 Sigurdsson ..... A47L 9/0072 15/339
2011/0214252 A1* 9/2011 McLeod ..... A47L 9/0072 15/415.1

(Continued)

FOREIGN PATENT DOCUMENTS

EP 2 160 968 3/2010
EP 2160968 A2 * 3/2010 ..... A47L 9/0072

(Continued)

OTHER PUBLICATIONS

Search Report dated Mar. 24, 2016, directed to GB application No. 1516665.5; 1 page.

(Continued)

*Primary Examiner* — Marc Carlson
(74) *Attorney, Agent, or Firm* — Morrison & Foerster LLP

(57) ABSTRACT

A handle assembly for a vacuum cleaner that includes a handle, a duct, a valve assembly, and a cover. The handle is attached to the duct, which has an inlet end, an outlet end, and a bleed aperture between. The valve assembly includes a valve and an actuator. The valve is moveable between closed and open positions by the actuator to close and open the bleed aperture. The cover surrounds the duct such that an upper part overlies the bleed aperture and valve. Holes are formed in a lower part of the cover. Suction at the outlet causes a primary airflow to be drawn into the duct via the inlet. When the valve is in the open position, the suction causes a secondary airflow to be drawn in through the holes, around the space between the duct and the cover, and into the duct via the bleed aperture.

16 Claims, 3 Drawing Sheets

(56) References Cited

U.S. PATENT DOCUMENTS

| | | | | |
|---|---|---|---|---|
| 2017/0071432 | A1* | 3/2017 | Millington | A47L 5/225 |
| 2017/0071433 | A1* | 3/2017 | Millington | A47L 9/327 |
| 2017/0290484 | A1* | 10/2017 | Emmett | A47L 5/225 |

FOREIGN PATENT DOCUMENTS

| | | | | |
|---|---|---|---|---|
| EP | 2 198 764 | | 6/2010 | |
| EP | 2198764 | A2 * | 6/2010 | A47L 9/0072 |
| EP | 2 542 138 | | 1/2013 | |
| WO | WO 2007052106 | A1 * | 5/2007 | A47L 9/0072 |
| WO | WO-2011/107766 | | 9/2011 | |

OTHER PUBLICATIONS

European Search Report dated Jan. 13, 2017, directed to EP Application No. 16 18 9391; 5 pages.

* cited by examiner

HANDLE ASSEMBLY FOR A VACUUM CLEANER

REFERENCE TO RELATED APPLICATION

This application claims the priority of United Kingdom Application No. 1516665.5, filed Sep. 21, 2015, the entire contents of which are incorporated herein by reference.

FIELD OF THE INVENTION

The present invention relates to a handle assembly for a vacuum cleaner.

BACKGROUND OF THE INVENTION

The handle assembly of a vacuum cleaner may comprise a duct through which a primary airflow is carried. The duct may include a bleed aperture through which a secondary airflow is admitted. The flow rate of the primary airflow can then be controlled by opening and closing the bleed aperture. Unfortunately the noise generated by the second airflow is often unpleasant.

SUMMARY OF THE INVENTION

The present invention provides a handle assembly for a vacuum cleaner comprising a handle, a duct, a valve assembly, and a cover, wherein the handle is attached to the duct, the duct has an inlet at one end, an outlet at an opposite end, and a bleed aperture located between the inlet and the outlet, the valve assembly comprises a valve and an actuator, the valve is moveable between a closed position and an open position, the valve closes the bleed aperture when in the closed position and opens the bleed aperture when in the open position, the actuator moves the valve from the closed position to the open position when actuated, the cover surrounds the duct such that an upper part of the cover overlies the bleed aperture and the valve, and one or more holes are formed in a lower part of the cover, suction at the outlet causes a primary airflow to be drawn into the duct via the inlet, and when the valve is in the open position, suction at the outlet causes a secondary airflow to be drawn in through the holes, around the space between the duct and the cover, and into the duct via the bleed aperture.

Owing to the provision of the cover and the location of the holes, the noise generated by the second airflow may be reduced. In particular, by locating the holes in a lower part of the cover, the noise generated by the second airflow may be directed away from the handle and thus away from the user.

The valve may pivot between the closed position and the open position. This then has the advantage of providing a relatively compact arrangement. In particular, the space between the cover and the duct that is required for movement of the valve may be kept relatively small. Pivoting of the valve may be achieved by pivotally attaching a first end of the valve to the duct or cover. Actuating the actuator may then cause a second opposite end of the valve to lift.

The handle may comprise a first portion and a second portion, the actuator may be moveably mounted to the first portion, and the second portion may form a handgrip. As a result, a user may grip the handle with one hand and then use a finger or thumb of the same hand to actuate the actuator.

The actuator may comprise a trigger attached to a rod, the rod may be housed inside the handle, and the rod may be attached to the valve. The only part of the valve assembly that is visible is therefore the trigger. Not only does this improve the aesthetic of the handle assembly, but it reduces the risk of dust and other dirt jamming the actuator.

The bleed aperture may face towards the handle. As a result, the valve assembly may be kept relatively simple. In particular, a relatively short and direct path may be taken between the actuator and the valve. In spite of the bleed aperture facing the handle, the cover ensures that the noise of the second airflow entering the bleed aperture is muffled and that the noise of the second airflow entering the holes is directed away from the handle.

The valve assembly may comprise a spring that biases the valve to the closed position. As a result, the bleed aperture is closed automatically whenever the actuator is released. This then avoids the situation in which a user, unaware that the bleed aperture is open, assumes that the reduction in the primary airflow is the result of a performance issue with the vacuum cleaner.

BRIEF DESCRIPTION OF THE DRAWINGS

In order that the present invention may be more readily understood, an embodiment of the invention will now be described, by way of example, with reference to the accompanying drawings in which.

DETAILED DESCRIPTION OF THE INVENTION

Figure 1:
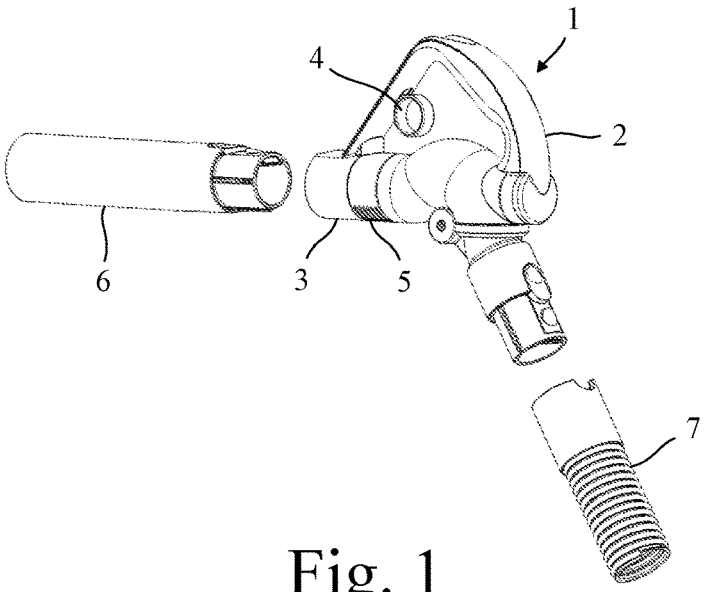
FIG. 1 shows a handle assembly in accordance with the present invention.
Figure 2:
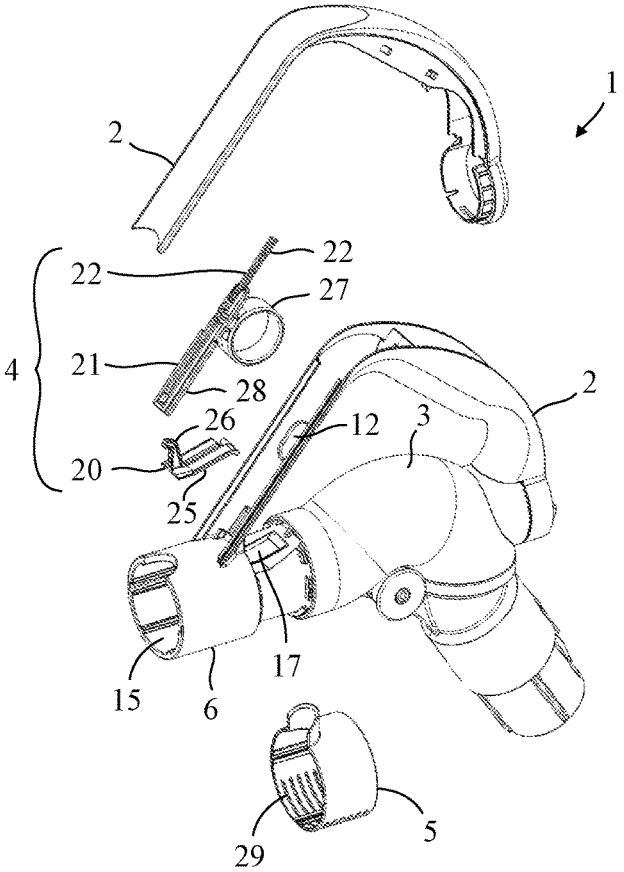
FIG. 2 is a partially exploded view of the handle assembly.
Figure 3:
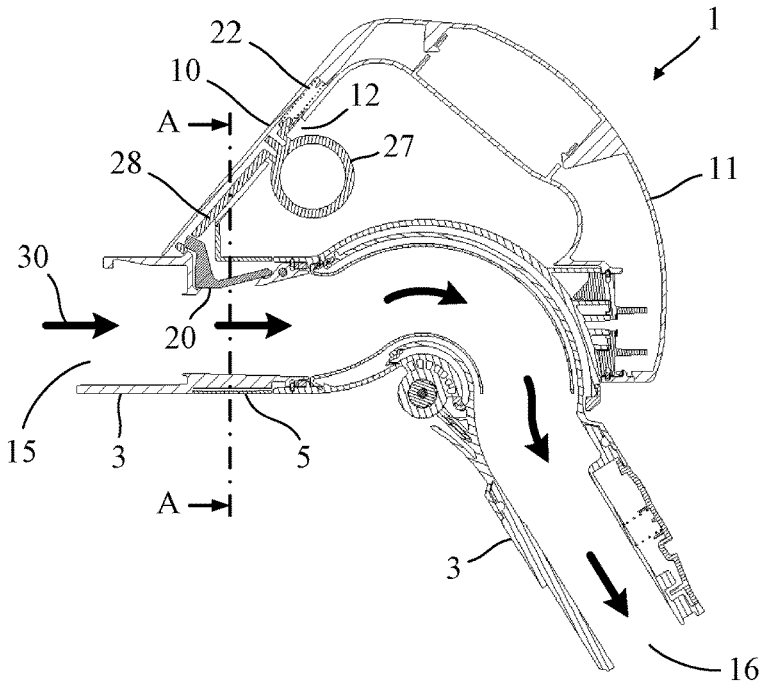
FIG. 3 is a sectional slice through the centre of the handle assembly with a valve of the handle assembly in a closed position.
Figure 4:
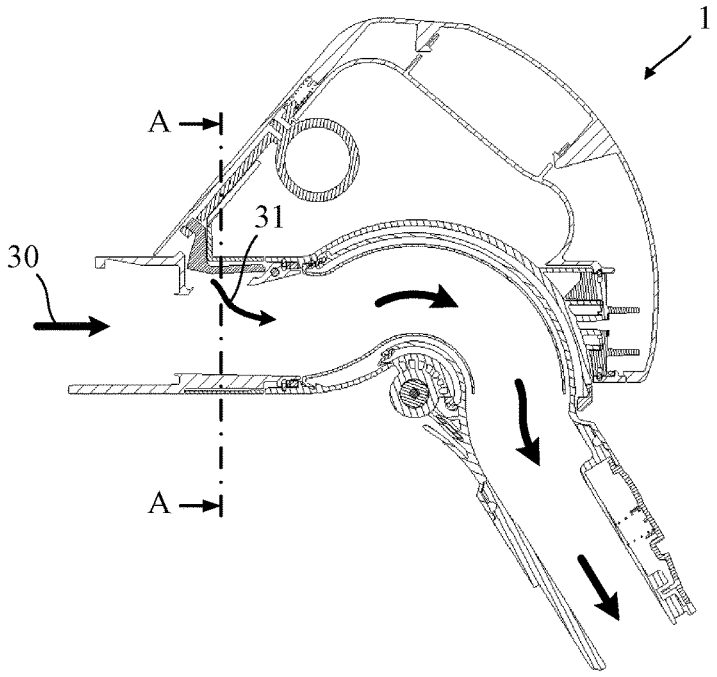
FIG. 4 is a sectional slice through the centre of the handle assembly with the valve in an open position.
Figure 5:
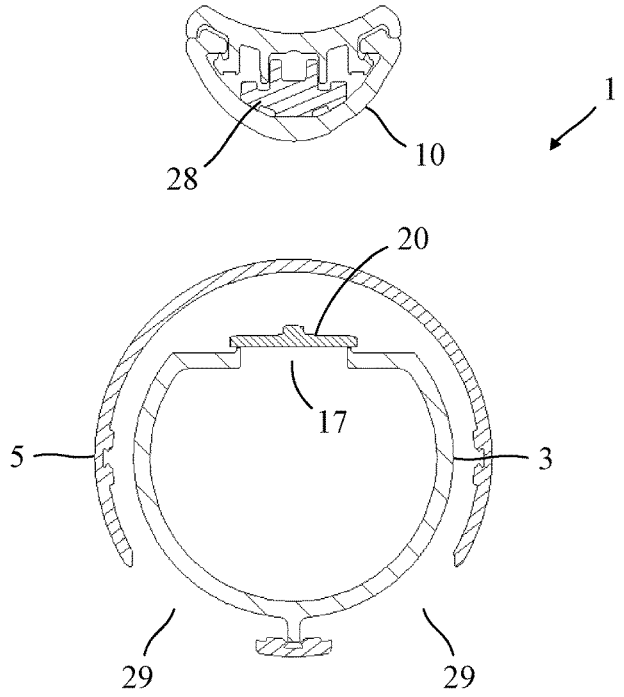
FIG. 5 is a sectional slice through the handle assembly in the plane A-A with the valve in the closed position.
Figure 6:
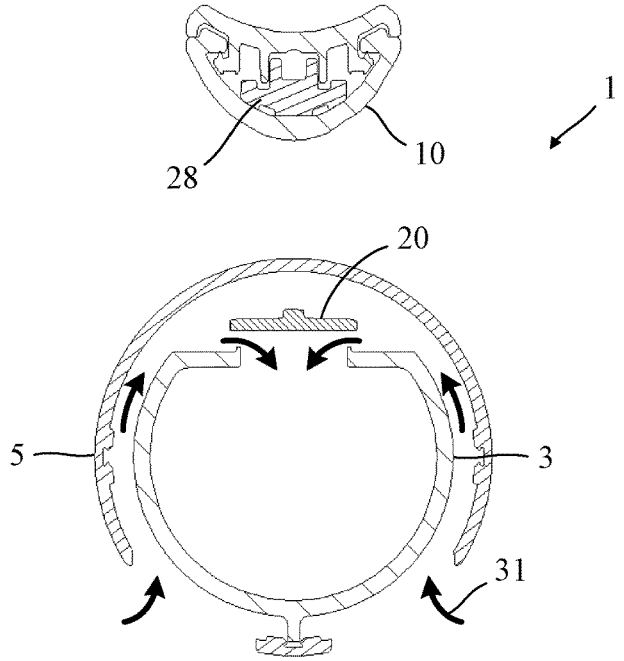
FIG. 6 is a sectional slice through the handle assembly in the plane A-A with the valve in the open position.

The handle assembly 1 of FIGS. 1 to 6 comprises a handle 2, a duct 3, a valve assembly 4, and a cover 5.

The handle 2 is attached to the duct 3 and comprises a first portion 10 and a second portion 11. The first portion 10 houses part of the valve assembly 4, which is described below in more detail, and the second portion 11 serves as a handgrip.

The duct 3 comprises a first end that is attachable to an elongate tube 6 or other attachment, and a second end that is attachable to a hose 7 of a vacuum cleaner (not shown). The duct 3 is composed of a number of sections that are joined together. This is done in order to provide relative rotation between the sections, which aids in the handling of the handle assembly 1. However, the provision of multiple sections is not pertinent to the present invention and the duct 3 might equally comprise a single section. The duct 3 comprises an inlet 15 at the first end, an outlet 16 at the second end, and a bleed aperture 17 located between the inlet 15 and the outlet 16.

The valve assembly 4 is moveably mounted to the handle 2 and comprises a valve 20, an actuator 21, and a spring 22.

The valve 22 comprises a panel 25 to which an arm 26 is attached. The panel 25 covers the bleed aperture 17 and is pivotally attached at a first end to the duct 3. The arm 26 extends upwardly from a second opposite end of the panel 25 and attaches to the actuator 21. The bleed aperture 17 is normally closed by the panel 25. However, when the actuator 21 is actuated, the actuator 21 lifts the arm 26 and thus the second end of the panel 25. The panel 25 then pivots in a manner similar to that of a trapdoor, thereby opening the bleed aperture 17. The valve 20 is therefore moveable between a closed position and an open position. When in the closed position the valve 20 closes the bleed aperture 17, and when in the open position the valve 20 opens the bleed aperture 17. The valve 20 is then moved between the closed and open positions by the actuator 21.

The actuator 21 comprises a trigger 27 attached to a rod 28. The rod 28 is housed within and extends along the first portion 10 of the handle 2. The trigger 27 is attached to the rod 28 via a slot 12 in the first portion 10, and the bottom of the rod 28 is attached to the arm 26 of the valve 20.

The spring 22 is housed within the first portion 10 of the handle 2 and biases the rod 28 downward. As a result, the valve 20 is biased to the closed position.

The location of the trigger 27 is chosen such that, when a user grips the second portion 11 of the handle 2, the user is able to latch on to the trigger 27 with a finger. Pulling the trigger 27 causes the rod 28 to move upwards within the first portion 10 of the handle 2 against the biasing force of the spring 22. The rod 28, being attached to the valve 20, causes the valve 20 to move to the open position. When the trigger 27 is subsequently released, the spring 22 biases the rod 28 downwards, and the valve 20 is returned to the closed position.

The cover 5 is tubular and surrounds the duct 3 such that an upper part of the cover 5 overlies the bleed aperture 17 and the valve 20. One or more holes 29 are then formed in a lower part of the cover 5.

During use, suction at the outlet 16 of the duct 3 causes a primary airflow 30 to be drawn into the duct 3 via the inlet 15. When the valve 20 is in the closed position, the bleed aperture 17 is closed and no additional airflow is drawn into the duct 3. When the valve 20 is in the open position, a secondary airflow 31 is drawn in through the holes 29 in the cover 5. From there, the secondary airflow 31 is drawn around the space between the duct 3 and the cover 5, and into the duct 3 via the bleed aperture 17. Since the bleed aperture 17 is located downstream of the inlet 15, the admission of the secondary airflow 31 into the duct 3 reduces the suction at the inlet 15 and thus the flow rate of the primary airflow 30.

Owing to the provision of the cover 5 and the location of the holes 29, the noise generated by the second airflow 31 appears quieter to the user. The total level of the noise may be no different to that generated by a handle assembly for which the cover is omitted. However, the cover 5 ensures that the noise generated by the second airflow 31 is directed away from the user. In particular, the noise generated by the second airflow 31 is directed away from the handle 2. By contrast, if the cover 5 were omitted, the noise generated by the second airflow 31 would be directed towards the user. This follows since the bleed aperture 17, which is now exposed, faces the handle 2. Consequently, whilst the total level of noise generated by the secondary airflow 31 may be unchanged, the cover 5 ensures that the noise perceived by the user is reduced.

The valve 20 pivots as it moves from the closed position to the open position. This then has the advantage of providing a relatively compact arrangement. In particular, a relatively small space is required between the duct 3 and the cover 5 in order for the valve 5 to move to the open position. In the embodiment described above, the valve 5 is pivotally attached to the duct 3. However, the valve 5 might alternatively be pivotally attached to the cover 5. Moreover, in spite of the aforementioned advantages, the valve 5 may translate rather than pivot when moving from the closed position to the open position. For example, the arm 26 of the valve 20 may be attached to or formed integrally with the rod 28 such that, as the rod 28 moves upwards, the panel 25 as a whole moves upwards.

In the embodiment described above, the actuator 21 comprises a trigger 27 that is pulled upwards in order to move the valve 20 to the open position. Conceivably, the actuator 21 may take alternative forms. By way of example only, the actuator 21 may comprise a button or slider provided on the first portion 10 of the handle 2 which, when depressed, moves the valve 20 to the open position.

The spring 22 ensures the valve 20 is returned automatically to the closed position when the actuator 21 is released. This then avoids the situation in which a user, unaware that the bleed aperture 17 is open, assumes that the reduction in the primary airflow 30 is the result of a performance issue with the vacuum cleaner. Whilst the spring 22 in the embodiment described above is a compression spring located at the top of the rod 28, it will be appreciated that the valve 20 may be biased to the closed position by other means, e.g. a tension spring located at the bottom of the rod 28, or a torsion spring located at the pivot joint of the valve 20. Moreover, in spite of the aforementioned advantage, there may be instances for which it is desirable to have a valve 20 that is not biased to the closed position. For example, omitting the spring 22 would have the benefit that the user is not required to maintain the actuator 21 in the actuated position in order to keep the bleed aperture 17 open.

The invention claimed is:

1. A handle assembly for a vacuum cleaner comprising a handle, a duct, a valve assembly, and a cover, wherein:
   - the handle is attached to the duct;
   - the duct has an inlet at one end, an outlet at an opposite end, and a bleed aperture located between the inlet and the outlet;
   - the valve assembly comprises a valve and an actuator;
   - the valve is moveable between a closed position and an open position, the valve closes the bleed aperture when in the closed position and opens the bleed aperture when in the open position;
   - the actuator moves the valve from the closed position to the open position when actuated;
   - the cover surrounds the duct and encloses the bleed aperture and the valve such that an upper part of the cover overlies the bleed aperture and the valve, and one or more holes are formed in a lower part of the cover;
   - suction at the outlet causes a primary airflow to be drawn into the duct via the inlet; and
   - when the valve is in the open position, suction at the outlet causes a secondary airflow to be drawn in through the holes, through a space between the duct and the cover in a circumferential direction around the duct, and into the duct via the bleed aperture.

2. The handle assembly of claim 1, wherein the valve pivots between the closed position and the open position.

3. The handle assembly of claim 2, wherein a first end of the valve is pivotally attached to the duct or cover, and actuating the actuator causes a second opposite end of the valve to be lifted.

4. The handle assembly of claim 1, wherein the handle comprises a first portion and a second portion, the actuator is moveably mounted to the first portion and the second portion forms a handgrip.

5. The handle assembly of claim 1, wherein the actuator comprises a trigger attached to a rod, the rod is housed inside the handle, and the rod is attached to the valve.

6. The handle assembly of claim 1, wherein the bleed aperture faces the handle.

7. The handle assembly of claim 1, wherein the valve assembly comprises a spring that biases the valve to the closed position.

8. A handle assembly for a vacuum cleaner comprising a handle, a duct, a valve assembly, and a cover, wherein:

the handle is attached to the duct;

the duct has an inlet at one end, an outlet at an opposite end, and a bleed aperture located between the inlet and the outlet;

the valve assembly comprises a valve and an actuator;

the valve is moveable between a closed position and an open position, the valve closes the bleed aperture when in the closed position and opens the bleed aperture when in the open position;

the actuator moves the valve from the closed position to the open position when actuated;

the cover surrounds the duct and overlies the bleed aperture and the valve so as to enclose the bleed aperture and the valve, and one or more holes are formed the cover;

suction at the outlet causes a primary airflow to be drawn into the duct via the inlet; and when the valve is in the open position, suction at the outlet causes a secondary airflow to be drawn in through the holes, in a circumferential direction around the duct, and into the duct via the bleed aperture.

9. The handle assembly of claim 8, wherein the valve pivots between the closed position and the open position, a first end of the valve is pivotally attached to the duct or cover, and actuating the actuator causes a second opposite end of the valve to be lifted.

10. The handle assembly of claim 8, wherein the actuator comprises a trigger attached to a rod, the rod is housed inside the handle, and the rod is attached to the valve.

11. The handle assembly of claim 8, wherein the bleed aperture faces the handle.

12. The handle assembly of claim 8, wherein the valve assembly comprises a spring that biases the valve to the closed position.

13. A handle assembly for a vacuum cleaner comprising a handle, a duct, a valve assembly, and a cover, wherein:

the handle is attached to the duct;

the duct has an inlet at one end, an outlet at an opposite end, and a bleed aperture located between the inlet and the outlet;

the valve assembly comprises a valve and an actuator;

the valve is pivotally attached to the duct or cover and pivots between a closed position and an open position, the valve closes the bleed aperture when in the closed position and opens the bleed aperture when in the open position;

the actuator causes the valve to pivot from the closed position to the open position when actuated;

the cover surrounds the duct such that a channel is formed between the cover and the duct, and the cover comprises one or more holes;

suction at the outlet causes a primary airflow to be drawn into the duct via the inlet; and when the valve is in the open position, suction at the outlet causes a secondary airflow to be drawn in through the holes, in a circumferential direction around the duct, and into the duct via the channel and the bleed aperture.

14. The handle assembly of claim 13, wherein the actuator comprises a trigger attached to a rod, the rod is housed inside the handle, and the rod is attached to the valve.

15. The handle assembly of claim 13, wherein the bleed aperture faces the handle.

16. The handle assembly of claim 13, wherein the valve assembly comprises a spring that biases the valve to the closed position.

* * * * *